US008889942B2

(12) United States Patent
Tallman

(10) Patent No.: US 8,889,942 B2
(45) Date of Patent: Nov. 18, 2014

(54) INTEGRATED LIGHT OLEFIN SEPARATION/CRACKING PROCESS

(75) Inventor: Michael J. Tallman, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 312 days.

(21) Appl. No.: 12/978,079

(22) Filed: Dec. 23, 2010

(65) Prior Publication Data

US 2012/0165591 A1 Jun. 28, 2012

(51) Int. Cl.

| | |
|---|---|
| ***C07C 4/02*** | (2006.01) |
| ***C07C 4/06*** | (2006.01) |
| ***C10G 11/18*** | (2006.01) |
| ***C10G 9/00*** | (2006.01) |

(52) U.S. Cl.

CPC ..... *C10G 11/18* (2013.01); *C10G 2300/4056* (2013.01); *C10G 9/00* (2013.01); *C10G 2400/20* (2013.01); *C10G 2300/1088* (2013.01)

USPC ..... 585/653; 585/820; 585/822; 585/826

(58) Field of Classification Search

USPC ..... 585/500, 648, 650, 651, 653, 800, 802, 585/809, 820, 826, 830

See application file for complete search history.

(56) References Cited

U.S. PATENT DOCUMENTS

| | | | | |
|---|---|---|---|---|
| 3,043,891 | A | 10/1954 | Stuckey | |
| 3,201,491 | A * | 8/1965 | Stine et al. | 210/676 |
| 3,265,750 | A * | 8/1966 | Peck et al. | 585/825 |
| 3,580,837 | A | 5/1971 | Pollitzer | |
| 3,691,246 | A | 9/1972 | Parker et al. | |
| 4,132,744 | A | 1/1979 | Knifton | |
| 4,514,285 | A | 4/1985 | Niccum et al. | |
| 5,043,522 | A | 8/1991 | Leyshon et al. | |
| 5,107,058 | A | 4/1992 | Chen et al. | |
| 5,200,059 | A | 4/1993 | Bogdan et al. | |
| 5,215,650 | A | 6/1993 | Sapre | |
| 6,049,017 | A | 4/2000 | Vora et al. | |
| 6,106,702 | A * | 8/2000 | Sohn et al. | 208/310 Z |
| 6,222,087 | B1 * | 4/2001 | Johnson et al. | 585/651 |
| 6,297,414 | B1 | 10/2001 | Barchas et al. | |
| 6,339,181 | B1 | 1/2002 | Chen et al. | |

(Continued)

FOREIGN PATENT DOCUMENTS

| | | |
|---|---|---|
| WO | WO 2007/111521 | 10/2007 |
| WO | WO 2008/120921 | 10/2008 |
| WO | WO 2008/133414 | 11/2008 |

OTHER PUBLICATIONS

Dries et al. Consider Using New Technology to Improve FCC unit Reliability. Hydrocarbon Processing, 2005. p. 1. http://www.hydrocarbonprocessing.com/Article/2599072/Consider-using-new-technology-to-improve-FCC-unit-reliability.html.*

*Primary Examiner* — Walter D Griffin
*Assistant Examiner* — Jelitza Perez
(74) *Attorney, Agent, or Firm* — Gary M. Machetta

(57) ABSTRACT

Systems and methods for producing a hydrocarbon are provided. The method can include separating a hydrocarbon comprising olefins and paraffins to produce an olefin-rich hydrocarbon comprising about 70 wt % or more olefins and a paraffin-rich hydrocarbon comprising about 70 wt % or more paraffins. The method can also include cracking at least a portion of the olefin-rich hydrocarbon in the presence of one or more catalysts at conditions sufficient to produce a cracked product comprising about 20 wt % or more $C_2$-$C_3$ olefins.

22 Claims, 4 Drawing Sheets

(56) References Cited

U.S. PATENT DOCUMENTS

| | | | | |
|---|---|---|---|---|
| 6,395,952 | B1 | 5/2002 | Barchas et al. | |
| 6,646,175 | B1 * | 11/2003 | Dath et al. | 585/651 |
| 7,011,740 | B2 | 3/2006 | Tallman et al. | |
| 7,128,827 | B2 | 10/2006 | Tallman et al. | |
| 7,153,479 | B2 | 12/2006 | Peterson et al. | |
| 7,491,315 | B2 * | 2/2009 | Eng et al. | 208/113 |
| 2009/0112031 | A1 | 4/2009 | Eng | |
| 2009/0112032 | A1 | 4/2009 | Eng | |
| 2009/0112038 | A1 | 4/2009 | Eng | |
| 2009/0112039 | A1 | 4/2009 | Eng | |
| 2009/0143629 | A1 | 6/2009 | Voskoboynikov | |
| 2009/0218255 | A1 * | 9/2009 | Claude et al. | 208/67 |
| 2009/0270665 | A1 | 10/2009 | Mendes et al. | |
| 2010/0048971 | A1 | 2/2010 | Kim et al. | |
| 2010/0116639 | A1 | 5/2010 | Park et al. | |

* cited by examiner

INTEGRATED LIGHT OLEFIN SEPARATION/CRACKING PROCESS

BACKGROUND

1. Field

Embodiments described herein generally relate to systems and methods for processing hydrocarbons. More particularly, such embodiments relate to systems and methods for processing a paraffin/olefin mixture in a fluidized catalytic cracking system.

2. Description of the Related Art

Fluidized catalytic cracking ("FCC") systems convert raw hydrocarbons into one or more products. One such FCC system converts olefin-rich hydrocarbon streams to predominantly propylene with significant quantities of ethylene and aromatic gasoline byproducts. In such FCC systems, olefins undergo high conversion levels, while paraffin conversions are substantially lower. Unconverted paraffins are typically recycled to extinction to a reactor that maximizes the ultimate yields of propylene and ethylene. Unfortunately, recycling the paraffins to extinction can result in a large buildup of recycle material, leading to higher capital expenses and/or higher energy consumption.

There is a need, therefore, for improved systems and methods for processing a paraffin/olefin mixture in FCC systems.

DETAILED DESCRIPTION

Systems and methods for producing a hydrocarbon are provided. In one or more embodiments, the method can include separating a hydrocarbon comprising olefins and paraffins to produce an olefin-rich hydrocarbon comprising about 70 wt % or more olefins and a paraffin-rich hydrocarbon comprising about 70 wt % or more paraffins. The method can also include cracking at least a portion of the olefin-rich hydrocarbon in the presence of one or more catalysts at conditions sufficient to produce a cracked product comprising about 20 wt % or more $C_2$-$C_3$ olefins.

Figure 1:
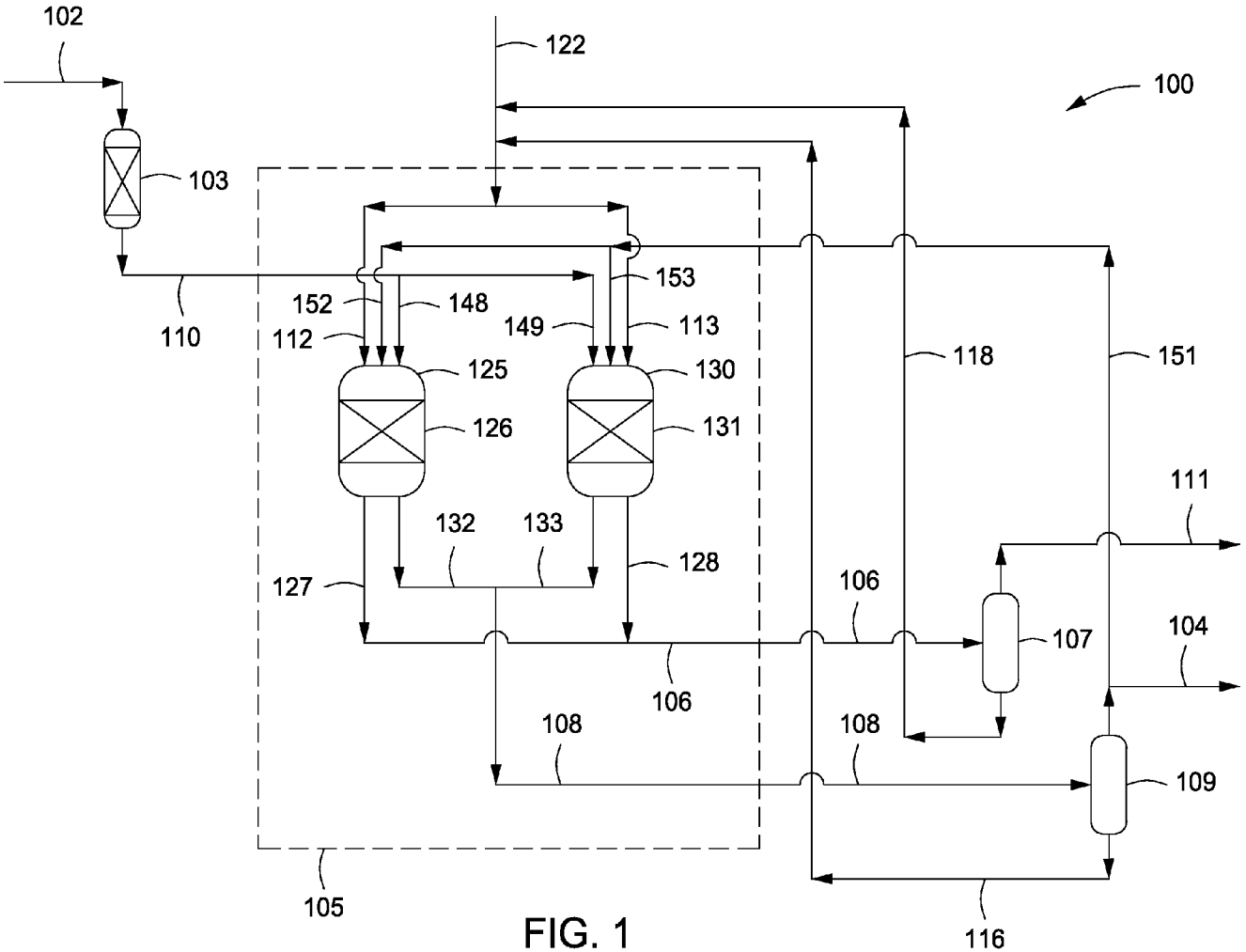
FIG. 1 depicts a schematic of an illustrative olefin/paraffin separation system, according to one or more embodiments described.

FIG. 1 depicts a schematic of an illustrative olefin/paraffin separation system 100, according to one or more embodiments. The olefin/paraffin separation system 100 can include one or more purifiers or guard beds 103, adsorbers 105, paraffin fractionators 107, and olefin fractionators 109. One or more hydrocarbon feeds or hydrocarbons via line 102 can be introduced to the olefin/paraffin separation system 100.

The hydrocarbon via line 102 can include, but is not limited to, one or more mixed olefins, one or more mixed paraffins, and/or any combination thereof. In one or more embodiments, the hydrocarbon via line 102 can originate from a refinery. For example, the hydrocarbon via line 102 can be a gas mixture resulting from the distillation of crude oil and/or the processing of one or more of its fractions. In one or more embodiments, the hydrocarbon via line 102 can contain hydrocarbon compounds having 12 or fewer carbon atoms. For example, the hydrocarbon via line 102 can include from about 0.1 percent by volume ("vol %") to about 35 vol % butane and from about 0.1 vol % to about 20 vol % pentane and heavier hydrocarbons. In one or more embodiments, the hydrocarbon via line 102 can include about 60 percent by weight ("wt %") or more, about 70 wt % or more, about 80 wt % or more, about 90 wt % or more, about 95 wt % or more $C_4$-$C_{12}$ olefins and paraffins. For example, the hydrocarbon via line 102 can have a $C_4$-$C_{12}$ olefin concentration ranging from a low of about 20 wt %, about 30 wt %, or about 40 wt % to a high of about 85%, about 90 wt %, or about 95 wt %. In another embodiment, the hydrocarbon via line 102 can include about 60 wt % or more, about 70 wt % or more, about 80 wt % or more, about 90 wt % or more $C_4$-$C_5$ olefins and paraffins. In yet another embodiment, the hydrocarbon via line 102 can include about 60 wt % or more, about 70 wt % or more, about 80 wt % or more, about 90 wt % or more $C_2$-$C_4$ olefins and paraffins.

The hydrocarbon via line 102 can optionally be introduced into the guard bed 103 to produce a purified hydrocarbon via line 110. The guard bed 103 can at least partially remove impurities in the hydrocarbon to reduce or prevent damage to and/or undesired problems in the adsorption process in the adsorber 105. The purified hydrocarbon via line 110 from the guard bed 103 can then be introduced to the adsorber 105. Although not shown, it will be appreciated that the hydrocarbon via line 102 can be introduced directly to the adsorber 105.

As illustrated, the adsorber 105 can include two adsorption/desorption units 125, 130, which can alternatingly be used to separate, i.e., adsorb and desorb, paraffins or olefins from the purified hydrocarbon via line 110. For example, the purified hydrocarbon via line 110 can be introduced via line 148 to the first adsorption/desorption unit 125. The first adsorption/desorption unit 125 can adsorb at least a portion of any olefins contained therein in the adsorption/desorption bed 126 and an olefin-lean hydrocarbon can be recovered via line 127. Once the adsorption/desorption bed 126 has adsorbed a sufficient amount of olefins or has become saturated with olefins, the purified hydrocarbon introduced via line 148 can be stopped and redirected via line 149 to the second adsorption/desorption unit 130. The second adsorption/desorption unit 130 can adsorb at least a portion of the olefins contained therein in the adsorption/desorption bed 131 to provide an olefin-lean hydrocarbon via line 128. Adsorption using two or more adsorption/desorption beds can be referred to as multi-bed adsorption.

An olefin selective adsorbent can be used in the adsorption/desorption beds 126, 131. For example, the adsorbent can be a $\pi$-complex adsorbent forming $\pi$-complex selectively with olefins, type X zeolite, or type Y zeolite. In one example, the adsorbent can be type 13X zeolite.

Once the purified hydrocarbon introduced via line 148 has been redirected via line 149, an olefin rinse can be introduced to the first adsorption/desorption unit 125 via line 152. The olefin rinse can be introduced to line 152 via a first recycle line 151 from the olefin product 104 or from another olefin source (not shown). The olefin rinse via line 152 can wash or flush out paraffins remaining in the adsorption/desorption unit 125, thereby adding the remaining paraffins to the olefin-lean hydrocarbon via lines 127.

A displacing medium or desorbent via line 122 can be introduced via line 112 to the first adsorption/desorption unit 125 to displace at least a portion of the adsorbed olefins and provide an olefin-rich hydrocarbon mixed with the displacing medium via line 132. Once the olefins have been displaced from the adsorption/desorption bed 126, the introduction of the displacing medium via line 112 can be stopped and/or redirected to another adsorption/desorption unit, e.g., the second adsorption/desorption unit 130. Illustrative displacing mediums can include any substance or combination of substances capable of removing adsorbed olefins or adsorbed paraffins from an adsorbent. Illustrative displacing mediums can include, but are not limited to, one or more alkanes, such as butane, pentane, hexane, heptane, octane, or any combination thereof.

Once the adsorption/desorption bed 131 has adsorbed a sufficient amount of olefins or has become saturated with olefins, the purified hydrocarbon introduced via line 149 can be stopped and/or redirected via line 148 to the adsorption/desorption unit 125, provided the adsorbed olefins have been desorbed and recovered via line 132. The olefin rinse can be introduced to the second adsorption/desorption unit 130 via line 153 to wash out or flush out paraffins remaining in the adsorption/desorption unit 130, thereby adding the remaining paraffins to the olefin-lean hydrocarbon via lines 128. The olefin rinse can be introduced to line 153 via the first recycle line 151 from the olefin product 104 or from another olefin source (not shown).

The displacing medium or desorbent via line 122 can be introduced via line 113 to the second adsorption/desorption unit 130, which can displace at least a portion of the adsorbed olefins to provide an olefin-rich hydrocarbon mixed with the displacing medium via line 133. Once the purified hydrocarbon has been redirected via line 148, the adsorption/desorption unit 125 can then again adsorb at least a portion of the olefins to provide the olefin-rich hydrocarbon via line 132. As such, the two adsorption/desorption units 125, 130 can be alternatingly operated such that the first adsorption/desorption unit 125 adsorbs olefins while the second adsorption/desorption unit 130 rinses or desorbs olefins and vice versa. Although two adsorption/desorption units are shown, it will be appreciated that more than two adsorption/desorption units can be used in a same or similar manner and/or sequence.

As shown, the purified hydrocarbon via lines 148, 149 and the displacing medium via lines 112, 113 can be introduced to the same end of the adsorption/desorption units 125, 130. Although not shown, purified hydrocarbon via lines 148, 149 and the displacing medium via lines 112, 113 can be introduced to opposing ends of the adsorption/desorption units 125, 130. The adsorption and desorption can be conducted co-currently with respect to one another or counter-currently with respect one another (not shown). For vertically oriented adsorption/desorption units 125, 130 the purified hydrocarbon via lines 148, 149 can be introduced to the adsorption/desorption units 125, 130, respectively, such that the purified hydrocarbon flows downwardly therethrough or upwardly therethrough (not shown). The displacing medium via lines 112, 113 can be introduced to the adsorption/desorption units 125, 130, respectively, such that the displacing medium flows downwardly therethrough or upwardly therethrough (not shown). In an alternative example, the co-current flow directions of the purified hydrocarbon and the displacing medium can be reversed.

The olefin-lean hydrocarbon recovered via lines 127, 128 from the adsorption/desorption units 125, 130 can be introduced via line 106 to the paraffin fractionator 107. Likewise, the olefin-rich hydrocarbon mixed with the displacing medium recovered via lines 132, 133 from the adsorption/desorption units 125, 130 can be introduced via line 108 to the olefin fractionator 109. The olefin-lean hydrocarbon via lines 127, 128 can include paraffins and desorbent from the first or second adsorption/desorption units 125, 130.

Although not shown, paraffins from the purified hydrocarbon via line 110 can be adsorbed in the adsorption beds 125, 130 instead of olefins. In this example, a paraffin-lean hydrocarbon can be recovered via lines 127, 128 instead of an olefin-lean hydrocarbon. Similar to the process described above with regard to adsorbed olefins, the adsorbed paraffins can be desorbed with the displacing medium via lines 112, 113 to provide a paraffin-rich hydrocarbon mixed with the displacing medium via lines 132, 133. In this example, although not shown, the paraffin-rich hydrocarbon mixed with the displacing medium via lines 132, 133 can be introduced to the paraffin fractionator 107 via line 106, and the paraffin-lean hydrocarbon via lines 127, 128 can be introduced to the olefin fractionator 109 via line 108.

The paraffin fractionator 107 can produce a paraffin-rich hydrocarbon via line 111 and a first recycle displacement medium via line 118. The first recycle displacement medium via line 118 can be recycled from the fractionator 107 to the adsorber 105 via line 122. The olefin fractionator 109 can produce the olefin-rich feed via line 104 and a second recycle displacement medium via line 116. The olefin-rich feed via line 104 can be recycled to the adsorber 105 via line 151, as discussed and described above. The second recycle displacement medium via line 116 can be recycled from olefin fractionator 109 to the adsorber 105 via line 122.

In one or more embodiments, the olefin-rich feed via line 104 from the olefin/paraffin separation system 100 can have about 70 wt % or more $C_2$-$C_{20}$ olefins, or about 70 wt % or more $C_2$-$C_{12}$ olefins, or about 70 wt % or more $C_2$-$C_8$ olefins or about 70 wt % or more $C_2$-$C_5$ olefins. In one or more embodiments, the paraffin-rich hydrocarbon via line 111 can have about 60 wt % or more $C_2$-$C_{20}$ paraffins, or about 60 wt % or more $C_2$-$C_{12}$ paraffins, or about 60 wt % or more $C_2$-$C_8$ paraffins, or about 60 wt % or more $C_2$-$C_5$ paraffins. The olefin concentration in the olefin-rich feed via line 104 from the hydrocarbon via line 102 can range from a low of about 90%, about 93%, or about 95% to a high of about 99%, about 99.6%, or about 99.99%. For example, the olefin concentration in the olefin-rich feed via line 104 can be about 94.5 wt % or more, about 97 wt % or more, about 98 wt % or more, about 99 wt % or more, or about 99.5 wt % or more. The paraffin concentration in the paraffin-rich hydrocarbon via line 111 can range from a low of about 70 wt %, about 75 wt %, or about 80 wt % to a high of about 85 wt %, about 90 wt %, about 95 wt %, or about 99 wt %.

The amount of olefins recovered from the hydrocarbon in line 102 and contained in the olefin-rich feed in line 104 can range from a low of about 90%, about 91%, about 93%, or about 95% to a high of about 97%, about 97.5%, about 98%, about 99.6%, or about 99.99% of the total amount of olefins in the hydrocarbon in line 102. For example, the amount of olefins contained in the hydrocarbon in line 102 that can be present in the olefin-rich feed in line 104 can be about 94.5% or more, about 95.5% or more, about 97% or more, about 98% or more, about 99% or more, or about 99.5% or more of the total amount of olefins present in the hydrocarbon in line 102. As such, in one or more embodiments, the olefin/paraffin separation system 100 can have separation efficiency of less than 100%.

In one or more embodiments, the olefin-rich feed via line 104 can have a concentration of $C_4$ hydrocarbons ranging from a low of about 5 wt %, about 10 wt %, about 15 wt %, or about 20 wt % to a high of about 80 wt %, about 85 wt %, about 90 wt %, about 95 wt %, about 97 wt %, about 98 wt %, about 99 wt %, about 99.5 wt %, or about 99.9 wt %. The olefin-rich feed via line 104 can have a concentration of $C_5$ hydrocarbons ranging from a low of about 5 wt %, about 10 wt %, about 15 wt %, or about 20 wt % to a high of about 80 wt %, about 85 wt %, about 90 wt %, about 95 wt %, about 97 wt %, or about 99 wt %. The olefin-rich feed via line 104 can have a concentration of $C_6$ hydrocarbons ranging from a low of about 0.5 wt %, about 1 wt %, about 5 wt %, or about 10 wt % to a high of about 30 wt %, about 35 wt %, about 40 wt %, about 45 wt %, or about 50 wt %. The olefin-rich feed via line 104 can have a concentration of $C_7$ hydrocarbons ranging from a low of about 0.5 wt %, about 1 wt %, about 5 wt %, or about 10 wt % to a high of about 30 wt %, about 35 wt %, about 40 wt %, about 45 wt %, or about 50 wt %. The olefin-rich feed via line 104 can have a concentration of $C_8$ hydrocarbons ranging from a low of about 0.5 wt %, about 1 wt %, about 5 wt %, or about 10 wt % to a high of about 30 wt %, about 35 wt %, about 40 wt %, about 45 wt %, or about 50 wt %.

Figure 2:
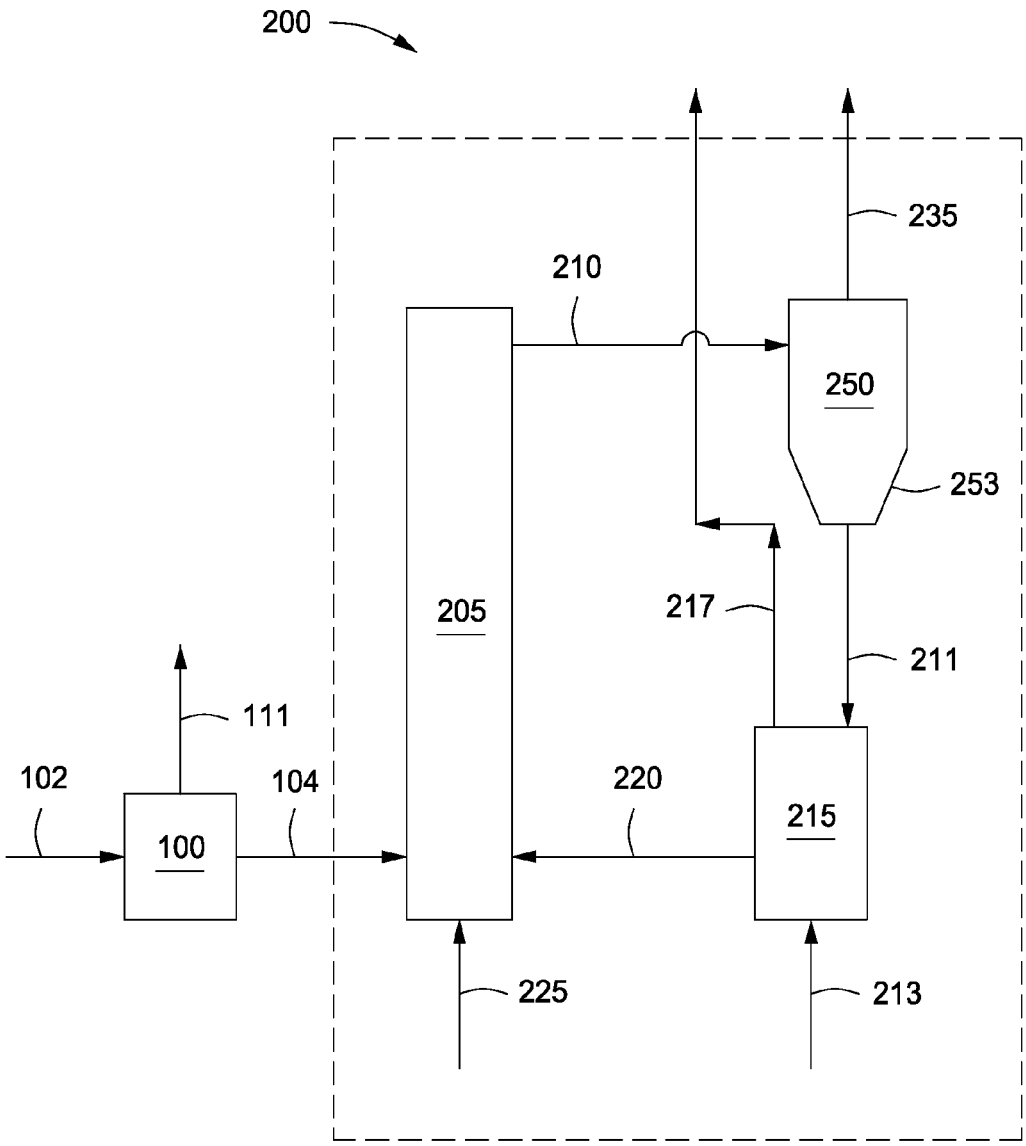
FIG. 2 depicts a schematic of an illustrative fluid catalytic cracking system fed by the olefin/paraffin separator, according to one or more embodiments described.

FIG. 2 depicts a schematic of an illustrative fluid catalytic cracking ("FCC") system 200 fed by the olefin/paraffin separation system 100, according to one or more embodiments. The FCC system 200 can include one or more reaction riser or risers 205, ducts or transition lines 210, separators 250, and regenerators 215. Although not shown, the FCC system 200 can also include a stripper.

Steam via line 225, the olefin-rich feed via line 104, and one or more catalysts via line 220 can be introduced to the reaction riser 205, forming a fluidized mixture ("reaction mixture") therein. The steam via line 225 and the catalyst via line 220 can be introduced separately to the reaction riser 205. Alternatively, the steam and the catalyst can be mixed and introduced together as a mixture to the reaction riser 205. In another alternative, the steam and the olefin-rich feed can be mixed and introduced together as a mixture to the reaction riser 205.

Heat in the reaction riser 205, provided by the steam via line 225 and the catalyst via line 220, can vaporize the olefin-rich feed introduced via line 104, if not already vapor, to provide the reaction mixture therein. Supplemental heat can be provided to the reaction risers 205 using waste heat provided from the regenerator 215. Within the reaction riser 205, the hydrocarbons within the reaction mixture can be cracked into one or more hydrocarbons and hydrocarbon by-products to provide a first product mixture via the transition line 210. At least a portion of the hydrocarbon by-products present in the reaction riser 205 can deposit on the surface of the catalyst particulates, forming coked-catalyst particulates or spent catalyst. Thus, the first product mixture exiting the reaction riser 205 can contain coked-catalyst particulates suspended in gaseous hydrocarbons, hydrocarbon by-products, carbon dust or particulates, steam, and other inerts. As such, the particulate-fluid mixture in the transition line 210 can be a reduced environment of gaseous hydrocarbons.

The amount of coke or carbon deposited on the catalyst particulates can range from a low of about 0.01 wt %, about 0.1 wt %, or about 0.5 wt % to a high of about 1 wt %, about 1.5 wt %, or about 3 wt %. For example, the amount of coke deposited on the catalyst particulates can range from about 0.5 wt % to about 1.5 wt %, from about 0.7 wt % to about 1.3 wt %, or from about 0.9 wt % to about 1.1 wt % based on the total weight of the carbon deposits and the catalyst particulates. In at least one specific embodiment, the amount of coke deposited on the catalyst particulates can be about 1 wt %.

The catalyst-to-hydrocarbon weight ratio can range from about 2:1 to about 35:1, from about 2:1 to about 20:1, from about 3:1 to about 10:1, or from about 4:1 to about 8:1. The reaction riser 205 can be operated at a temperature ranging from a low of about 425° C., about 450° C., about 475° C., or about 500° C. to a high of about 635° C., about 675° C., about 700° C., or about 825° C. For example, the reaction riser 205 can be operated at a temperature ranging from about 400° C. to about 675° C., from about 605° C. to about 670° C., from about 610° C. to about 660° C., or from about 615° C. to about 650° C. In at least one specific embodiment, the reaction riser 205 can be operated at a temperature of about 605° C., about 615° C., about 625° C., about 630° C., about 640° C., or about 650° C.

The pressure in the riser can range from a low of about 40 kPa, about 55 kPa, about 65 kPa, or about 70 kPa to a high of about 650 kPa, about 675 kPa, about 700 kPa, or about 725 kPa. Other ranges can be found in U.S. Pat. No. 7,128,827, incorporated by reference herein. In one specific embodiment, cracking can occur at a temperature of from about 590° C. to about 675° C. and at a pressure of from about 68 kPa to about 690 kPa.

The velocity of the reaction mixture flowing through the reaction riser 205 can range from about 3 msec to about 27 msec, about 6 msec to about 25 msec, or about 9 msec to about 21 msec. The residence time of the reaction mixture in the reaction riser 205 can be less than about 20 seconds, less than about 10 seconds, less than about 8 seconds, less than about 4 seconds, or less than about 2 seconds.

The olefin-rich feed introduced via line 104 can be preheated prior to introduction to the reaction riser 205. Although not shown in FIG. 2, a regenerative heat exchanger using waste process heat can be used to pre-heat the olefin-rich feed introduced via line 104. The temperature of the olefin-rich feed via line 104 can range from about 200° C. to about 500° C., about 300° C. to about 400° C., or about 350° C. to about 390° C. The pressure of the olefin-rich hydrocarbon via line 104 can range from about 101 kPa to about 3,450 kPa, about 101 kPa to about 2,450 kPa, or about 101 kPa to about 700 kPa.

The olefin-rich feed introduced via line 104 can be partially or completely vaporized prior to introduction to the reaction riser 205. The amount of the olefin-rich feed via line 104 that can be vaporized can range from a low of about 1 vol %, about 5 vol %, about 10 vol %, about 20 vol %, about 30 vol %, or about 40 vol % to a high of about 70 vol %, about 80 vol %, about 90 vol %, or about 100 vol %. For example, the olefin-rich feed can be about 80 wt % or more vaporized, about 85 wt % or more vaporized, about 90 wt % or more vaporized, about 95 wt % or more vaporized, or about 99 wt % or more vaporized or completely vaporized prior to introduction to the reaction riser 205. In another example, the olefin-rich feed via line 104 can be 100% vapor for 90% of the time. Within the reaction riser 205, the pressure and temperature can be adjusted either manually or automatically to compensate for variations in the composition of the olefin-rich feed via line 104 and to maximize the yield of preferred hydrocarbons obtained in a first product recovered via line 235 by cracking the olefin-rich feed via line 104 in the presence of the one or more catalysts.

The steam introduced via line 225 to the reaction riser 205 can be saturated. The pressure of the saturated steam can be from about 101 kPa to about 6,000 kPa, about 500 kPa to about 6,000 kPa, or about 2,000 kPa to about 6,000 kPa. For example, the pressure of the saturated steam can range from about 101 kPa to about 8,300 kPa, about 101 kPa to about 4,000 kPa, or about 101 kPa to about 2,000 kPa.

The steam introduced via line 225 to the reaction riser 205 can be superheated. The pressure of the superheated steam can be from a low of about 100 kPa to a high of about 8,500 kPa. The pressure of the superheated steam via line 225 can range from about 100 kPa to about 8,300 kPa, about 100 kPa to about 4,000 kPa, or about 100 kPa to about 2,000 kPa. The temperature of the superheated steam via line 225 can be a minimum of about 200° C., about 230° C., about 260° C., or about 290° C.

The steam can optionally be introduced via line 225 to the reaction riser 205 at a rate proportionate to the olefin-rich hydrocarbon feed rate introduced via line 104. In one example, the steam-to-hydrocarbon weight ratio can range from about 1:10 to about 1:15 or about 1:5 to about 1:30. The steam-to-hydrocarbon weight ratio can remain constant or can vary.

The first product mixture can flow, via the transition line 210, to the separator 250, where the coked-catalyst particulates and/or other particulates can be separated from the gaseous hydrocarbons, steam, and inerts. The separator 250 can have a larger cross-sectional area than the reaction riser 205 and/or the transition line 210, which reduces the velocity of the first product mixture, allowing the heavier coked-catalyst particulates and/or other particulates to separate from the gaseous hydrocarbons, steam, and inerts. In one or more embodiments, a steam purge (not shown) can be added to the separator 250 to assist in separating the gaseous hydrocarbons from the coked-catalyst particulates, i.e., stripping the gaseous hydrocarbons from the solids. In other words, the separator 250 can be a self-stripping separator, e.g., a self-stripping cyclone.

Figure 3:
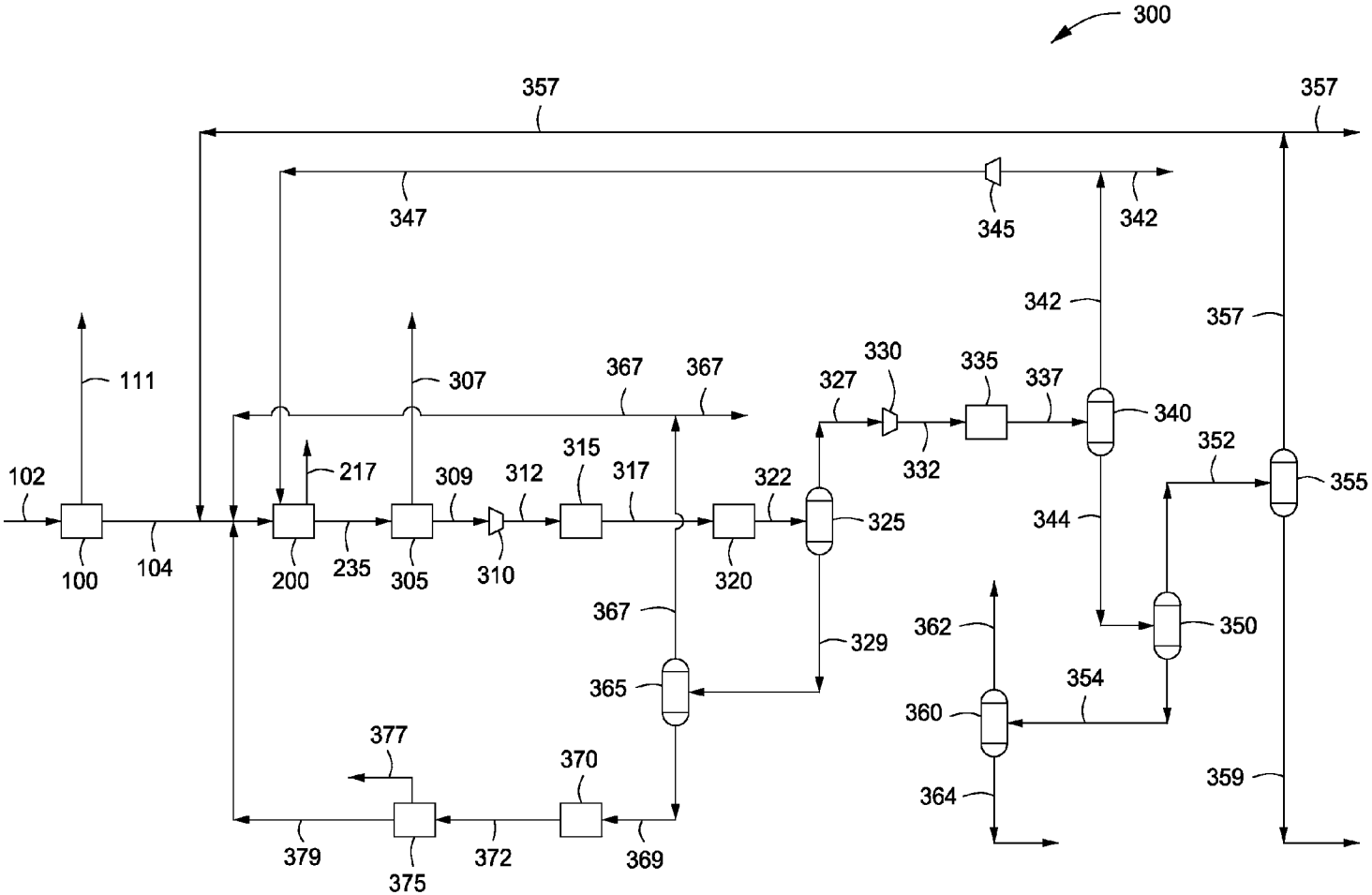
FIG. 3 depicts a schematic of an illustrative system for producing one or more olefins, according to one or more embodiments described.
Figure 4:
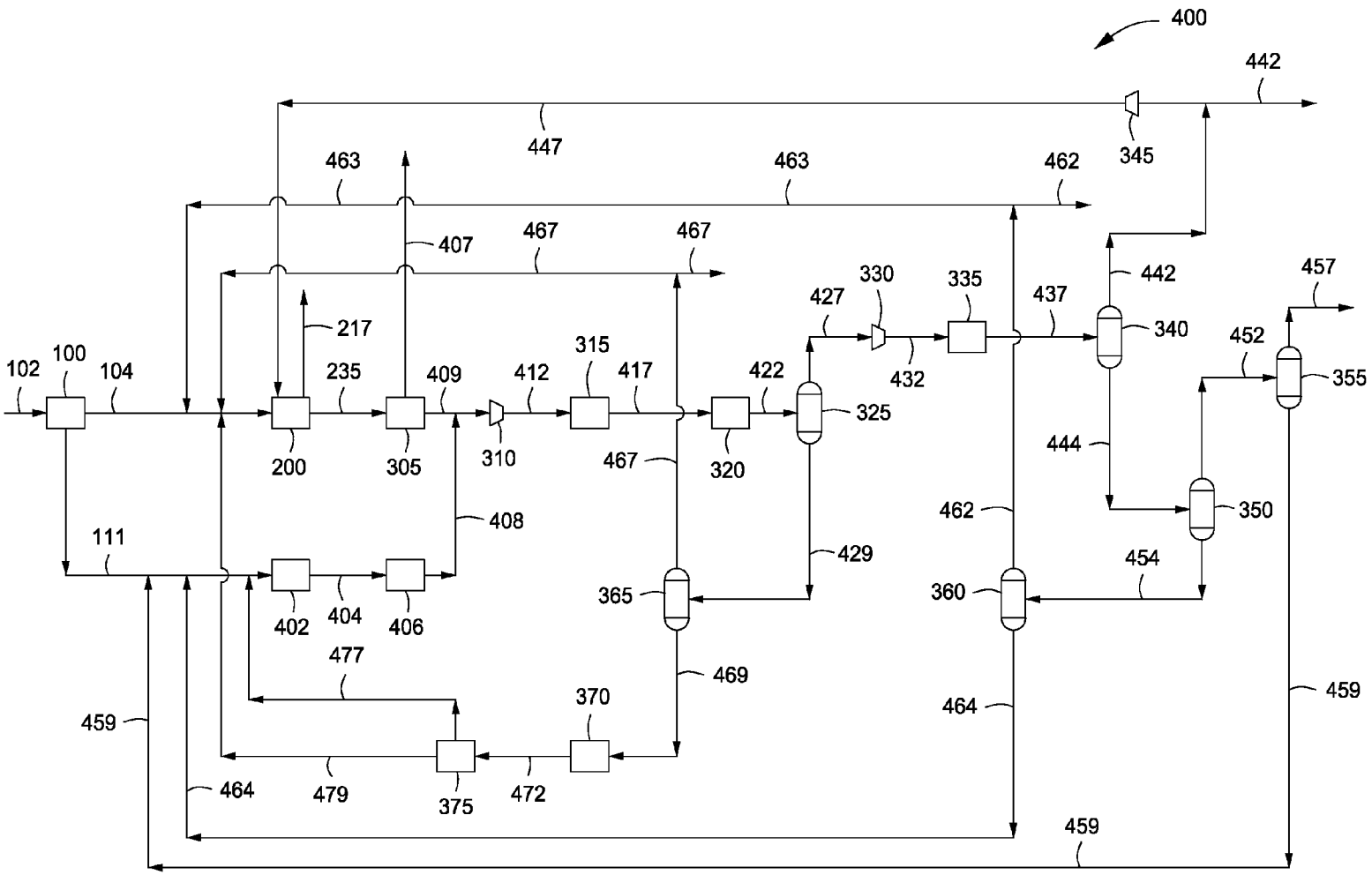
FIG. 4 depicts a schematic of another illustrative system for producing one or more olefins, according to one or more embodiments described.

The gaseous hydrocarbons ("first product") via line 235 can be recovered from the separator 250. As shown in FIGS. 3 and 4, in one or more embodiments, the first product in line 235 can be further processed, such as by dehydrating or fractionating to provide one or more finished products including, but not limited to, one or more olefins, paraffins, aromatics, mixtures thereof, and/or combinations thereof. For example, the first product via line 235 can be introduced to a quench tower (not shown) that quenches the first product and separates entrained catalyst particulates therefrom. Entrained catalyst particulates separated from the first product can then be recycled back to the reaction riser 205 or to the regenerator 215. A suitable FCC system having a quench tower for quenching and separating entrained catalyst particulates from the first product is discussed and described in U.S. Pat. Nos. 7,153,479 and/or 7,011,740, which is incorporated by reference herein.

The separator 250 can separate from a low of about 90%, about 90.5%, about 91%, or about 91.5% to a high of about 98%, about 99%, about 99.5%, or about 99.999% of the particulates from the first product mixture via the transition line 210. For example, the separator 250 can separate of from about 90% to about 99.9%, about 95% to about 99%, or about 97.5% to about 99.999% of the particulates from the first product mixture via the transition line 210.

The solids, i.e., coked-catalyst particulates, can free fall through the separator 250 and can be introduced via line 211 to the regenerator 215. Although not shown, at least a portion of the solids can be introduced to the regenerator after passing through a stripper. The coked-catalyst particulates introduced via line 211 can be combined with one or more fluids introduced via line 213 within the regenerator 215 to provide a flue gas via line 217 and regenerated catalyst via line 220. The fluid introduced via line 213 can include one or more oxidants and/or supplemental fuel. Illustrative oxidants can include, but are not limited to, air, oxygen, oxygen, oxygen-enriched air, ozone, hydrogen peroxide, an essentially nitrogen-free oxidant, or any combination thereof. As used herein, the term "essentially oxygen" refers to a fluid containing more than 50 vol % oxygen. As used herein, the term "oxygen-enriched air" refers to a fluid containing about 21 vol % oxygen to about 50 vol % oxygen. Oxygen-enriched air and/or essentially oxygen can be obtained, for example, from cryogenic distillation of air, pressure swing adsorption, membrane separation, or any combination thereof. As used herein, the term "essentially nitrogen-free," refers to an oxidant that contains about 5 vol % nitrogen or less, about 4 vol % nitrogen or less, about 3 vol % nitrogen or less, about 2 vol % nitrogen or less, or about 1 vol % nitrogen or less. The supplemental fuel can include any combustible material. For example, the supplemental fuel can include, but is not limited to, $C_1$ to $C_{20}$ hydrocarbons and/or carbon. The supplemental fuel can be introduced to the regenerator 215 as a liquid, gas, solid, or any combination thereof. The supplemental fuel can be introduced in a separate line from the oxidant. The oxidants can react with the carbonaceous matter on the coked-catalyst particulates to combust or otherwise burn the carbon ("coke") off the surface of the catalyst particulate. Should the supplemental fuel be introduced, the oxidants can react with the supplemental fuel to combust the supplemental fuel and generate heat. The removal of the coke from the surface of the catalyst particulates re-exposes the reactive surfaces of the catalyst particulates, thereby "regenerating" the catalyst particulates and permitting reuse thereof. Combustion by-products, such as carbon monoxide, nitrogen oxides, nitrogen oxide precursors, and carbon dioxide, can be removed from the regenerator 215 as a waste or flue gas via line 217. The regenerated catalyst particulates can be recovered via line 220, which can be recycled to the reaction riser 205. In one or more embodiments, fresh, unused, catalyst can be added (not shown) to the regenerator 215, the regenerated catalyst in line 220, and/or to the reaction riser 205.

The regenerator 215 can be operated in full burn mode, partial burn mode, or anywhere in between. Operating the regenerator 215 in full burn mode can provide an exhaust gas or flue gas via line 217 that can contain a larger amount of nitrogen oxides ("NOx") and NOx precursors and a decreased amount of carbon monoxide (CO) relative to the partial burn mode. Operating the regenerator 215 in a partial burn mode can provide an exhaust gas or flue gas via line 217 that can contain a larger amount of CO and a lesser amount of NOx and NOx precursors relative to the full burn mode. Operating the regenerator 215 in between the two extremes of full burn and partial burn can provide an exhaust gas via line 217 that contains less NOx and NOx precursors and more CO when compared to the full burn mode. The NOx gases can include, but are not limited to, NO, $NO_2$, and $N_2O$. In another example, the NOx precursors can include, but are not limited to, HCN, $NH_3$, CN, and HNO.

The flue gas via line 217 can be introduced to one or more optional CO boilers (not shown) to remove additional CO. The one or more CO boilers can be any type of CO boiler. The CO boiler can be operated in multiple stages to reduce the flame temperature occurring in any one stage and limit NOx formation in an oxidizing atmosphere. Low NOx burners can also be used to burn a fuel gas (not shown) to keep the CO boiler lit. Ammonia or an ammonia precursor, such as urea, can be introduced (not shown) to the optional CO boiler to reduce NOx emissions even further. These materials can react quickly with NOx and NOx precursors to reduce it to nitrogen.

At least a portion of the flue gas via line 217 and/or flue gas from the optional CO boiler can be vented to the atmosphere and/or sent to one or more heat recovery units (not shown) and then vented to the atmosphere, sequestered underground, or otherwise disposed. The optional CO boiler, if used, can reduce the CO content of the flue gas via line 217 in an amount ranging from a low of about 5%, about 10%, about 15%, about 20% to a high of about 75%, about 80%, about 85%, or about 90%. For example, the optional CO boiler can reduce the CO content of the flue gas via line 217 by from about 5% to about 90%, from about 5% to about 75%, from about 5% to about 60%, or from about 5% to about 50%.

Although not shown, a carbon dioxide ($CO_2$) separation unit can be used to remove at least a portion of the $CO_2$ from the flue gas via line 217. $CO_2$ can be removed for sequestration or reuse, e.g., reuse through enhanced oil recovery.

The one or more optional heat recovery units (not shown) can include any device, system, or combination of systems and/or devices suitable for transferring heat from a fluid at a higher temperature to a fluid at a lower temperature. For example, the heat recovery unit can include, but is not limited to single or multiple pass heat exchange devices, such as shell and tube heat exchangers, plate and frame heat exchangers, spiral heat exchangers, bayonet type heat exchangers, U-tube heat exchangers, and/or any similar system or device.

A fluidized mixture containing spent catalyst particulates, regenerated catalyst particulates, oxidants, carbon monoxide, carbon dioxide, nitrogen oxides, and/or the fluid introduced via line 213 can be combined within the regenerator 215 with one or more optional doping agents introduced thereto. The dispersal and deposition of the doping agents on the regenerated catalyst can be enhanced by the high temperature and fluid velocity present in the regenerator 215. Although not shown, the optional doping agents can be mixed with a supplemental fuel, for example natural gas, and introduced to the regenerator 215. The use of supplemental fuel can provide additional heat within the regenerator 215, further enhancing the regeneration of the coked-catalyst particulates therein.

The selection of an appropriate doping agent or additive or blend of two or more doping agents or additives can be based, at least in part, upon the composition of the incoming olefin-rich feed via line 104, and/or desired gaseous hydrocarbons to be produced in the first product via line 235. For example, the addition of a class 2 doping agent such as magnesium or barium can preferentially increase the production of ethylene in the first product recovered via line 235. In another example, the addition of a class 13 doping agent, such as gallium, can result in increased production of aromatic hydrocarbons in the first product recovered via line 235. In yet another example, the addition of class 8, 9, or 10 doping agents such as ruthenium, rhodium, or palladium can preferentially increase the production of propylene in the first product recovered via line 235.

Doped catalyst particulates and/or regenerated catalyst particulates with or without one or more doping agents or additives can be recycled to the reaction riser 205 via line 220. The flow of regenerated catalyst particulates from the regenerator 215 can be controlled using one or more valves (not shown), which can be manually or automatically adjusted or controlled based upon parameters derived from process temperatures, pressures, flows, and/or other process conditions. About 90 wt % or more, about 95 wt % or more, about 99 wt % or more, or about 99.99 wt % or more of the regenerated catalyst particulates, makeup catalyst particulates, and/or doped catalyst particulates introduced via line 220 to the reaction riser 205 can be regenerated, optionally doped with one or more doping agents, and recycled via line 220 back to the reaction riser 205.

Although not shown, the particulate discharge section 253 of the separator 250 and/or line 211 can include one or more valves to manually or automatically adjust or control the flow of spent catalyst to the regenerator 215 based on parameters derived from process temperatures, pressures, flows, and/or other process conditions.

FIG. 3 depicts a schematic of an illustrative system 300 for producing one or more olefins, according to one or more embodiments. As explained above, a hydrocarbon via line 102 can be introduced into the olefin/paraffin separation system 100 to produce the paraffin-rich feed via line 111 and the olefin-rich feed via line 104.

The olefin-rich feed via line 104 can be cracked or selectively separated within one or more FCC systems 200 to produce the first product via line 235, which can contain naphtha, propylene, ethylene, butane, mixtures thereof, and/or combinations thereof. A regenerator waste gas or flue gas from the FCC system 200 can be recovered via line 217.

The first product via line 235 can exit the FCC system 200 at a temperature of about 480° C. to about 750° C., about 550° C. to about 700° C., or about 600° C. to about 650° C. The first product via line 235 can include about 40 wt %, about 50 wt %, about 60%, or about 95 wt % or more $C_2$-$C_{10}$ hydrocarbons. For example, the first product via line 235 can include from about 5 wt % to about 30 wt % $C_2$, about 5 wt % to about 60 wt % $C_3$, about 5 wt % to about 65 wt % $C_4$, and/or about 5 wt % to about 50 wt % $C_5$ and heavier hydrocarbons. In another example, the first product via line 235 can include about 15 wt % or more, about 20 wt % or more, about 25 wt % or more, about 30 wt % or more, about 35 wt % or more $C_2$-$C_3$ olefins.

The first product via line 235 can be fractionated and/or purified using one or more fractionators 305, treating units 315, drying units 320, and separators 325, 340, 350, 355, 360, and 365 to provide multiple products, including propylene, ethylene, propane, and ethane. One or more products, including methane, ethylene, and heavier $C_4$-$C_6$ hydrocarbons can be internally recycled to the one or more FCC systems 200, e.g., to the regenerator 215.

The first product via line 235 can be selectively separated using the fractionator 305 to provide a naphthenic mixture via line 307 and an olefinic mixture via line 309. The olefinic mixture can include a major portion of one or more $C_2$-$C_{10}$ olefins and paraffins. The naphthenic mixture can include $C_8$-$C_{15}$ hydrocarbons, and/or one or more heavy gasolines. For example, the naphthenic mixture can include from about 10 wt % to about 40 wt % $C_8$, from about 5 wt % to about 20 wt % $C_9$, or about 10 wt % or more $C_{10}$-$C_{15}$ hydrocarbons. The naphthenic mixture can include, but is not limited to, one or more fuel oils and/or one or more heavy gasolines.

The olefinic mixture via line 309 can include from about 40 wt % to about 95 wt % or more $C_2$-$C_{10}$ olefins. For example, the olefinic mixture can include from about 5 wt % to about 30 wt % $C_2$, about 5 wt % to about 60 wt % $C_3$, about 5 wt % to about 65 wt % $C_4$, from about 5 wt % to about 50 wt % $C_5$. The pressure of the olefinic mixture exiting the fractionator 305 can range from a low of about 120 kPa, about 130 kPa, about 150 kPa to a high of about 200 kPa, about 250 kPa, or about 300 kPa. In another example, the olefinic mixture via line 309 can include about 15 wt % or more, about 20 wt % or more, about 25 wt % or more, about 30 wt % or more, about 35 wt % or more $C_2$-$C_3$ olefins.

The olefinic mixture via line 309 can be compressed using one or more compressors 310 to provide a compressed olefinic mixture via line 312. Compressing the olefinic mixture can facilitate the removal of oxygenates, acid gases, water, or any combination thereof from the olefinic mixture in line 309. The compressed olefinic mixture via line 312 can exit the compressor 310 at a pressure ranging from about 100 kPa to about 5,000 kPa, about 100 kPa to about 3,000 kPa, or about 100 kPa to about 1,000 kPa. The compressed olefinic mixture via line 312 can be at a temperature of from about 40° C. to about 300° C.

The compressed olefinic mixture via line 312 can be treated in the treating unit 315 to remove at least a portion of any oxygenates, acid gases, water, or any combination thereof to provide a treated olefinic mixture via line 317. The treating unit 315 can include any system, device, or combination of systems and/or devices suitable for removing oxygenates, acid gases, water, derivatives thereof, and/or mixtures thereof, which are known in the art of hydrocarbon refining. The treated olefinic mixture via line 317 can include about 500 parts per million by volume ("ppmv") or less hydrogen sulfide ("$H_2S$"), about 50 ppmv or less $H_2S$, or about 1 ppmv or less $H_2S$. The treated olefinic mixture can include about 500 ppmv or less $CO_2$, about 100 ppmv or less $CO_2$, or about 1 ppmv or less $CO_2$.

The treated olefinic mixture via line 317 can be dried using the drying unit 320 to produce a dried olefinic mixture via line 322. The dried olefinic mixture via line 322 can include about 100 ppmv or less water, about 10 ppmv or less water, about 1 ppmv or less water, or about 0.1 ppmv or less water. The drying unit 320 can include any system, device, or combination of systems and/or devices suitable for removing water from a hydrocarbon to provide a dried olefinic mixture via line 322. For example, the drying unit 320 can include systems that use desiccants, solvents, or any combination thereof for removing water from a hydro carbon.

The dried olefinic mixture via line 322 can be introduced to the separator ("de-propanizer") 325 and selectively separated therein to provide an overhead having $C_3$ and lighter hydrocarbons via line 327 and a bottoms having $C_4$ and heavier hydrocarbons via line 329. The overhead via line 327 can include from about 90 wt % to about 99 wt % $C_3$ and lighter hydrocarbons. The overhead via line 327 can further include from about 10 wt % up to about 40 wt % $C_2$, from about 20 wt % up to about 70 wt % $C_3$, and from about 0.1 wt % to about 2 wt % hydrogen. The overhead via line 327 can exit the de-propanizer 325 at pressures ranging from about 500 kPa to about 2,500 kPa, from about 500 kPa to about 1,500 kPa, or from about 500 kPa to about 1,000 kPa.

The bottoms in line 329 can include about 90 wt %, about 95 wt %, or about 99 wt % $C_4$-$C_{10}$. The $C_4$ and heavier hydrocarbons can range from about 30 wt % to about 80 wt % $C_4$, from about 5 wt % to about 30 wt % $C_5$, from about 5 wt % to about 20 wt % $C_6$, and from about 5 wt % to about 20 wt % $C_7$ and heavier hydrocarbons.

The separator ("de-propanizer") 325 can include, but is not limited to, a column containing internal components, as well as one or more condensers and/or reboilers. The de-propanizer 325 can include packing media to facilitate the selective separation of $C_3$ and lighter hydrocarbons from the $C_4$ and heavier hydrocarbons. For example, the de-propanizer 325 can include one or more saddles, balls, irregular sheets, tubes, spirals, trays, and/or baffles. The operating pressure of the de-propanizer 325 can range from about 500 kPa to about 2,500 kPa, and the operating temperature of the de-propanizer 325 can range from about −60° C. to about 100° C.

The bottoms via line 329 can be introduced to the separator ("gasoline splitter") 365 and selectively separated therein to provide an overhead containing $C_4$-$C_6$ hydrocarbons except benzene via line 367 and a bottoms containing benzene and $C_7$ and heavier hydrocarbons via line 369. The overhead via line 367 can include butanes and isobutanes. For example, the overhead via line 367 can include from about 50 wt % to about 95 wt % butanes and can include from about 10 wt % to about 50 wt % isobutanes. The overhead via line 367 can include from about 10 wt % to about 50 wt % $C_4$ olefins, from about 5 wt % to about 30 wt % $C_5$ olefins, and from about 5 wt % to about 20 wt % $C_6$ olefins.

All or any portion of the overhead via line 367 can be recycled to the FCC system 200. For example, from about 10 wt % to about 100 wt %, from about 20 wt % to about 100 wt %, from about 30 wt % to about 100 wt %, from about 40 wt % to about 100 wt %, or from about 45 wt % to about 100 wt % of the overhead via line 367 can be recycled to the FCC system 200. In another example, only the $C_4$ hydrocarbons in line 367 can be recycled to the FCC system 200. In yet another example, only the $C_5$ hydrocarbons in line 367 can be recycled to the FCC system 200.

The gasoline splitter 365 can include any device, system, or combination of devices and/or systems suitable for selectively separating a hydrocarbon mixture to provide the overhead via line 367 containing the $C_4$-$C_6$ hydrocarbons without benzene and the bottoms via line 369 containing the benzene and $C_7$ and heavier hydrocarbons. The gasoline splitter 365 can include, but is not limited to, a column containing internal components, as well as one or more condensers and/or reboilers. The gasoline splitter 365 can include packing media to facilitate the selective separation of $C_6$ and lighter hydrocarbons from the benzene and $C_7$ and heavier hydrocarbons. For example, the gasoline splitter 365 can include trays, saddles, balls, irregular sheets, tubes, spirals, and/or baffles. The operating pressure of the gasoline splitter 365 can range from about 100 kPa to about 2,500 kPa, and the operating temperature can range from about 20° C. to about 400° C.

All or any portion of the $C_7$ and heavier hydrocarbons via line 369 can be introduced to one or more gasoline hydrotreaters 370 and stabilized therein to provide a treated gasoline via line 372. The treated gasoline via line 372 can include about 70 wt % or more, about 80 wt % or more, or about 90 wt % or more $C_6$ and heavier hydrocarbons. The treated gasoline via line 372 can include about 75 wt % to about 85 wt % $C_6$, about 15 wt % to about 25 wt % $C_7$, and about 5 wt % to about 10 wt % $C_8$ and heavier hydrocarbons. The gasoline hydrotreater 370 can include any system, device, or combination of systems and/or devices suitable for stabilizing a mixed hydrocarbon. For example, the gasoline hydrotreater 370 can include a system that stabilizes gasoline by treating the gasoline with hydrogen.

All or any portion of the treated gasoline via line 372 can be introduced to one or more benzene/toluene/xylene ("BTX") units 375 to provide one or more aromatics via line 377 and a raffinate via line 379. The one or more aromatics via line 377 can include, but are not limited to, benzene, toluene, xylene, or any combination thereof ("aromatics"). The aromatics via line 377 can include about 40 wt %, about 50 wt %, about 60 wt %, about 70 wt %, or about 80 wt % BTX. The BTX can include from about 10 wt % to about 40 wt % benzene, from about 20 wt % to about 60 wt % toluene, and from about 10 wt % to about 40 wt % xylene.

At least a portion of the raffinate via line 379 can be combined with the olefin-rich feed via line 104 and recycled to the FCC system 200. Alternatively or simultaneously, at least a portion of the raffinate via line 379 can be directly recycled to the FCC system 200. For example, about 10 wt % or more, about 20 wt % or more, about 30 wt % or more, or about 40 wt % or more of the raffinate via line 379 can be recycled to the reaction riser 205, either directly or via line 104. In another example, about 10 wt %, about 15 wt %, or about 20 wt % of the raffinate via line 379 can be recycled to the riser 205 of the FCC system 200 via line 104 or recycled directly to the FCC system 200 (not shown). Although not shown, the raffinate via line 379 can be further processed. For example, all or any portion of the raffinate 379 can be directed to a steam pyrolytic cracker (not shown) to recover any olefinic or paraffinic hydrocarbons contained therein.

Returning to the de-propanizer 325, the overhead via line 327 can be compressed using one or more compressors 330 to provide compressed $C_3$ and lighter hydrocarbons via line 332. Compressing the $C_3$ and lighter hydrocarbons can facilitate the subsequent separation of the lighter compounds from the $C_3$. The pressure of the compressed $C_3$ and lighter hydrocarbons can range from about 500 kPa to about 4,000 kPa.

The compressed $C_3$ and lighter hydrocarbons via line 332 can be cooled using one or more chill trains 335 to provide chilled $C_3$ and lighter hydrocarbons via line 337. The temperature of the chilled $C_3$ and lighter hydrocarbons via line 337 can range from about −40° C. to about 40° C. For example, the chilled $C_3$ and lighter hydrocarbons via line 337 can have a temperature from about −20° C. to about 5° C.

The chilled $C_3$ and lighter hydrocarbons via line 337 can be selectively separated using the separator ("de-methanizer") 340 to provide an overhead via line 342 having methane and/or $H_2$ and a bottoms via line 344 having $C_2$ and $C_3$ hydrocarbons. The overhead via line 342 can include from about 50 mol % to about 95 mol % methane. For example, the overhead via line 342 can include from a low of about 70 mol %, about 72 mol %, or about 75 mol % to a high of about 80 mol %, about 85 mol %, or about 90 mol % methane. The bottoms via line 344 can include from about 20 wt % to about 50 wt % $C_2$ and from about 40 wt % to about 80 wt % $C_3$. The operating pressure of the de-methanizer 340 can range from about 300 kPa to about 1,000 kPa. The $C_2$ and $C_3$ hydrocarbons via line 344 can include up to about 95 wt % $C_2$-$C_3$ or more.

All or any portion of the methane in the overhead via line 342 can be compressed using one or more compressors 345 to provide compressed methane via line 347, which can be recycled to the FCC system 200. For example, from about 15 vol % to about 35 vol %, from about 20 vol % to 35 vol %, from about 25 vol % to 35 vol %, or from about 30 vol % to 35 vol % of the compressed methane via line 347 can be recycled to the regenerator 215 in the FCC system 200. The compressed methane exiting the compressor 345 can be at a temperature ranging from about 25° C. to about 200° C.

The bottoms via line 344 can be introduced to the separator ("de-ethanizer") 350 and selectively separated therein to provide an overhead via line 352 having a $C_2$ hydrocarbon mixture and a bottoms via line 354 having a $C_3$ hydrocarbon mixture. The overhead 352 can include from a low of about 90 mol %, about 91 mol %, or about 92 mol % to a high of about 95 mol %, about 97 mol %, or about 99.9 mol % $C_2$ hydrocarbon mixture. The overhead via line 352 can contain from about 5 mol % to about 70 mol % ethane and from about 30 mol % to about 95 mol % ethylene. The bottoms via line 354 can include from a low of about 90 mol %, about 91 mol %, or about 92 mol % to a high of about 95 mol %, about 97 mol %, or about 99.9 mol % $C_3$ hydrocarbons. The $C_3$ hydrocarbons via line 354 can include from about 5 mol % to about 30 mol % propane and from about 70 mol % to about 95 mol % propylene. The operating pressure of the de-ethanizer 350 can range from about 500 kPa to about 2,500 kPa, and the temperature in the de-ethanizer 350 can range from about −80° C. to about 100° C.

At least a portion of the $C_2$ hydrocarbon mixture in the overhead via line 352 can be introduced to the separator ("C2 splitter") 355 and selectively separated therein to provide an ethylene product via line 357 and an ethane product via line 359. The ethane product via line 359 can include about 90 mol % or more, about 95 mol % or more, about 99 mol % or more, or about 99.9 mol % or more ethane. The ethylene product via line 357 can include about 90 mol % or more, about 95 mol % or more, about 99 mol % or more, or about 99.95 mol % or more ethylene.

All or any portion of the ethylene product via line 357 can be recycled to the FCC system 200. Recycling at least a portion of the ethylene product can suppress propylene production in the FCC system 200, thereby increasing the yield of ethylene in the first product via line 235. For example, from about 10 vol % to about 60 vol %, about 20 vol % to about 60 vol %, about 30 vol % to about 60 vol %, about 40 vol % to about 60 vol %, or about 50 vol % to about 60 vol % of the ethylene product via line 357 can be recycled to the FCC system 200. In an alternative example, from about 60 vol % to about 99 vol %, from about 70 vol % to about 95 vol %, or from about 80 vol % to about 90 vol % of the ethylene product via line 357 can be recycled to the FCC system 200. In one or more embodiments, at least a portion of the ethylene present via line 357 can be removed as a finished product.

The C2 splitter 355 can be any device, system, or combination of devices and/or systems suitable for selectively separating a hydrocarbon mixture to provide the ethylene product via line 357 and the ethane product via line 359. The C2 splitter 355 can include, but is not limited to, a column containing internal components, condensers, and/or reboilers. The operating pressure of the C2 splitter 355 can range from about 500 kPa to about 2,500 kPa. The operating temperature of the C2 splitter 355 can range from about −80° C. to about 100° C.

The bottoms via line 354 can contain $C_3$ hydrocarbons and can be introduced to the separator ("C3 splitter") 360 and selectively separated therein to provide a propylene product ("second product") via line 362 and a propane product via line 364. The propane product via line 364 can contain from a low of about 90 mol %, about 91 mol %, or about 92 mol % to a high of about 95 mol %, about 97 mol %, or about 99 mol % propane. The propylene product via line 362 can include from about 60 wt % to about 99.9 wt % propylene.

The C3 splitter 360 can be any device, system, or combination of systems and/or devices suitable for selectively separating the $C_3$ hydrocarbon mixture to provide the propylene product via line 362 and the propane product via line 364. The C3 splitter 360 can include, but is not limited to, a column containing internal components, as well as one or more condensers and/or reboilers. The operating pressure of the C3 splitter 360 can range from about 500 kPa to about 2,500 kPa, and the operating temperature of the C3 splitter can range from about −100° C. to about 100° C.

FIG. 4 depicts a schematic of another illustrative system 400 for producing one or more olefins, according to one or more embodiments. As discussed and described above, a hydrocarbon via line 102 can be introduced into the olefin/paraffin separation system 100 to produce the paraffin-rich feed via line 111 and the olefin-rich feed via line 104.

The olefin-rich feed via line 104 can be introduced to the FCC system 200 and cracked therein to provide the first product via line 235, and a regenerator waste gas or flue gas form the FCC system 200 can be recovered via line 217. The paraffin-rich feed can be introduced via line 111 to one or more cracking systems or crackers 402 to provide an effluent ("cracked alkanes") via line 404. For example, the cracker 402 can include one or more steam pyrolytic crackers or paraffin FCC systems. The cracked alkanes via line 404 can be cooled using one or more quench columns 406 to provide a quenched effluent via line 408.

The paraffin-rich feed introduced via line 111 to the cracker 402 can include one or more paraffinic hydrocarbons having two or more carbon atoms. For example, the alkanes can include one or more $C_1$-$C_{12}$ paraffinic hydrocarbons. The paraffin-rich feed via line 111 can be introduced to the cracker 402 at a temperature of about 25° C. to about 200° C. and at a pressure ranging from a low of about 100 kPa to a high of about 2,000 kPa.

The paraffin-rich feed via line 111 can include $C_1$-$C_{12}$ alkanes. For example, the paraffin-rich feed via line 111 can include ethane, propane, butane, pentane, hexane, octane, mixtures thereof, and/or combinations thereof. The paraffin-rich feed via line 111 can include from about 70 wt % to about 90 wt % $C_2$-$C_3$ alkanes. Although not shown, the paraffin-rich feed via line 111 can be introduced to a convection zone of a steam pyrolytic cracker at a temperature ranging from a low of about 50° C. to a high of about 300° C. The paraffin-rich feed via line 111 can be heated in the convection zone to a temperature of about 400° C. to about 700° C. The paraffin-rich feed via line 111 can be partially or completely vaporized in the convection zone. For example, from a low of about 10 wt %, about 15 wt %, or about 20 wt % to a high of about 30 wt %, about 40 wt %, or about 50 wt % of the paraffin-rich feed via line 111 can be vaporized in the convection zone (not shown). In another example, about 55 wt % or more, about 65 wt % or more, about 75 wt % or more, about 85 wt % or more, about 95 wt % or more, or about 100 wt % of the paraffin-rich feed via line 111 can be vaporized in the convection zone (not shown).

The paraffin-rich feed via line 111 can undergo cracking or pyrolysis to produce a cracked product that includes smaller alkanes and/or alkenes via line 404. The cracked product via line 404 can include, but is not limited to, methane, ethane, propane, butane, pentane, hexane, ethylene, propylene, butene, pentene, hexene, or any combination thereof. The cracked alkanes via line 404 can include, but are not limited to, about 30 wt %, 40 wt %, about 50 wt %, about 60%, or about 95 wt % or more $C_2$-$C_{10}$ hydrocarbons. For example, the cracked alkanes via line 404 can include from about 5 wt % to about 90 wt % $C_2$, about 5 wt % to about 60 wt % $C_3$, about 5 wt % to about 65 wt % $C_4$, and/or about 5 wt % to about 50 wt % $C_5$ and heavier hydrocarbons. In another example, the cracked alkanes via line 404 can include about 20 wt % or more, about 25 wt % or more, or about 30 wt % or more $C_2$-$C_3$ olefins.

Although not shown in FIG. 4, one or more mixed hydrocarbon feeds can be introduced to one or more pre-fractionators. Within the one or more pre-fractionators, the mixed hydrocarbon feed can be fractionated or otherwise selectively separated to provide at least a portion of the hydrocarbon in line 102 and/or at least a portion of the paraffin-rich feed via line 111.

The first product in line 235 can be fractionated using the one or more fractionators 305 to provide an olefinic mixture via line 409 and a naphthenic mixture via line 407. The olefinic mixture via line 409 can be combined with the quenched effluent via line 408 and purified using the one or more treating units 315, 320, and columns or separators 325, 340, 350, 355, 360, and 365 to provide multiple products including propylene, ethylene, propane, and ethane. Heavier $C_4$-$C_6$ hydrocarbons, separated from the finished products, can be recycled to the FCC system 200 and/or the cracker 402.

The olefinic mixture via line 409 can include one or more $C_2$-$C_{10}$ olefins. The olefinic mixture via line 409 can include from about 40 wt % to about 95 wt % or more $C_2$-$C_{10}$ hydrocarbons. For example, the olefinic mixture via line 409 can include from about 5 wt % to about 30 wt % $C_2$, about 5 wt % to about 60 wt % $C_3$, about 5 wt % to about 65 wt % $C_4$, from about 5 wt % to about 50 wt % $C_5$. The olefinic mixture can exit the fractionator 305 via line 409 at a pressure ranging from a low of about 120 kPa up to a high of about 300 kPa.

The naphthenic mixture can include $C_8$-$C_{15}$ hydrocarbons, and/or one or more heavy gasolines. For example, the naphthenic mixture via line 407 can include from about 40 wt % to about 90 wt % $C_8$-$C_{12}$ hydrocarbons. For example, the naphthenic mixture via line 407 can include from about 10 wt % to about 40 wt % $C_8$, from about 5 wt % to about 20 wt % $C_9$, and about 10 wt % or more $C_{10}$-$C_{15}$ hydrocarbons.

The quench column 406 can be any device, system, or combination of systems and/or devices suitable for reducing the temperature of the cracked hydrocarbon mixture via line 404. In one or more embodiments, reducing the temperature of the cracked hydrocarbon can reduce or stop the rate of hydrocarbon cracking. The quench column 406 can include packing media to provide surface area for the cracked alkanes and a heat transfer medium to make thermal contact. For example, the packing media can include trays, rings, saddles, balls, irregular sheets, tubes, spirals, baffles, or any combination thereof. The quenched effluent via line 408 can exit the quench column 406 at a temperature ranging from about 25° C. to about 100° C. The quenched effluent via line 408 can include from about 20 wt % to about 60 wt % ethane and from about 5 wt % to about 30 wt % propane.

The quenched effluent via line 408 can be combined with the olefinic mixture via line 409 and compressed using one or more compressors 310 to provide a compressed olefinic mixture via line 412. The compressed olefinic mixture via line 412 can exit the compressor 310 at a pressure of from about 500 kPa to about 4,000 kPa. For example, the pressure of the compressed olefinic mixture via line 412 can range from about 500 kPa to about 3,000 kPa, about 500 kPa to about 2,000 kPa, or about 500 kPa to about 1,000 kPa. The compressed olefinic mixture in line 412 can be at a temperature of from about 40° C. to about 300° C.

The compressed olefinic mixture via line 412 can be treated using one or more treating units 315 to remove at least a portion of any oxygenates, acid gases, water, or any combination thereof to provide a treated olefinic mixture via line 417. The treated olefinic mixture via line 417 can include about 500 ppmv or less $H_2S$, about 50 ppmv or less $H_2S$, or about 1 ppmv or less $H_2S$. The treated olefinic mixture via line 417 can include about 500 ppmv or less $CO_2$, about 100 ppmv or less $CO_2$, or about 50 ppmv or less $CO_2$.

The treated olefinic mixture via line 417 can be dried in the one or more drying units 320 to provide dried olefinic mixture via line 422. The dried olefinic mixture can include about 100 ppmv or less water, about 10 ppmv or less water, about 5 ppmv or less water, about 1 ppmv or less water, about 0.5 ppmv or less water, or about 0.1 ppmv or less water.

The dried olefinic mixture in line 422 can be introduced to one or more de-propanizers 325 and selectively separated therein to provide an overhead having $C_3$ and lighter hydrocarbons via line 427 and a bottoms having $C_4$ and heavier hydrocarbons via line 429. The $C_3$ and lighter hydrocarbons via line 427 can include from about 90 wt % to about 99 wt % $C_3$ and lighter hydrocarbons. The $C_3$ and lighter hydrocarbons can include hydrogen. The $C_3$ and lighter hydrocarbons can include from about 10 wt % to about 40 wt % $C_2$, from about 20 wt % to about 70 wt % $C_3$, and from about 0.1 wt % to about 2 wt % $H_2$. The $C_3$ and lighter hydrocarbons via line 427 can exit the de-propanizer 325 at a pressure of from about 500 kPa to about 2,500 kPa or from about 500 kPa to about 1,000 kPa.

The $C_4$ and heavier hydrocarbons via line 429 can include from about 90 wt % to about 99 wt % $C_4$-$C_{10}$ hydrocarbons. The $C_4$ and heavier hydrocarbons via line 429 can include from about 30 wt % to about 80 wt % $C_4$, from about 5 wt % to about 30 wt % $C_5$, from about 5 wt % to about 20 wt % $C_6$, and from about 5 wt % to about 20 wt % $C_7$ and heavier hydrocarbons.

The $C_4$ and heavier hydrocarbons via line 429 can be introduced to one or more gasoline splitters 365 and selectively separated therein to provide an overhead containing $C_4$-$C_6$ hydrocarbons except benzene via line 467 and bottoms containing benzene and $C_7$ and heavier hydrocarbons via line 469. The $C_7$ and heavier hydrocarbons via line 469 can include from about 5 wt % to about 80 wt % $C_7$. For example, the $C_7$ and heavier hydrocarbons can include from about from about 1 wt % to about 20 wt % $C_7$ and from about 1% to about 10 wt % $C_8$ and heavier hydrocarbons.

At least a portion of the $C_4$-$C_6$ hydrocarbons via line 467 can be recycled directly to the FCC system 200. For example, about 55 wt % to about 65 wt %, about 65 wt % to about 75 wt %, about 75 wt % to about 85 wt %, or about 85 wt % to about 95 wt % of $C_4$-$C_6$ hydrocarbons via line 467 can be recycled to the FCC system 200. In an alternative example, about 10 wt % to about 20 wt %, about 20 wt % to about 30 wt %, about 30 wt % to about 40 wt %, or about 40 wt % to about 50 wt % of the $C_4$-$C_6$ hydrocarbons via line 467 can be recycled to the FCC system 200. In yet another example, only the $C_4$ hydrocarbons in line 367 can be recycled to the FCC system 200. In still yet another example, only the $C_5$ hydrocarbons in line 367 can be recycled to the FCC system 200. At least a portion of the $C_4$-$C_6$ hydrocarbons via line 467 can be combined with the olefin-rich feed via line 104. For example, about 10 wt % to about 20 wt %, about 20 wt % to about 30 wt %, about 30 wt % to about 40 wt %, or about 40 wt % to about 50 wt % of $C_4$-$C_6$ hydrocarbons via line 467 can be combined with the olefin-rich feed via line 104. In an alternative example, about 5 wt % to about 35 wt %, about 15 wt % to about 55 wt %, about 45 wt % to about 70 wt %, about 60 wt % to about 85 wt %, or about 75 wt % to about 100 wt % of the $C_4$-$C_6$ hydrocarbons via line 467 can be combined with olefin-rich feed via line 104.

The $C_4$-$C_6$ hydrocarbons via line 467 can include butanes and isobutanes. For example, the $C_4$-$C_6$ hydrocarbons via line 467 can include from about 10 wt % to about 50 wt % butanes and from about 10 wt % to about 50 wt % isobutanes. The $C_4$-$C_6$ hydrocarbons via line 467 can also include from about 50 wt % to about 90 wt % $C_4$-$C_6$ olefins. For example, the $C_4$-$C_6$ hydrocarbons via line 467 can include from about 10 wt % to about 50 wt % $C_4$ olefins, from about 10 wt % to about 50 wt % $C_5$ olefins, and from about 5 wt % to about 30 wt % $C_6$ olefins.

The benzene and $C_7$ and heavier hydrocarbons via line 469 can be stabilized using the one or more gasoline hydrotreaters 370 to provide a treated gasoline via line 472. The treated gasoline can include from about 70 wt % to about 90 wt % $C_6$ and heavier hydrocarbons. The treated gasoline can include from about 75 wt % to about 85 wt % $C_6$, from about 15 wt % to about 25 wt % $C_7$, and from about 5 wt % to about 10 wt % $C_8$ and heavier hydrocarbons.

The treated gasoline via line 472 can be selectively separated using the one or more BTX units 375 to separate the aromatics via line 477 and a raffinate via line 479. The aromatics concentration in line 479 can include from a low of about 40 wt % or about 50 wt % to a high of about 60 wt %, about 70 wt %, or about 80 wt % BTX. The aromatics via line 477 can include from about 10 wt % to about 40 wt % benzene, from about 20 wt % to about 60 wt % toluene, and from about 10 wt % to about 40 wt % xylene. At least a portion of the raffinate via line 479 can be directly recycled to the FCC system 200 (not shown in FIG. 4) or recycled to the FCC system 200 via line 104. For example, from a low of about 10 wt %, about 15 wt %, or about 20 wt % to a high of about 30 wt %, about 35 wt %, or about 40 wt % of the raffinate via line 479 can be recycled to the FCC system 200. In at least one specific example, about 10 wt %, about 15 wt %, or about 20 wt % of the aromatics via line 479 can be recycled to FCC system 200.

The raffinate via line 479 can be lean in aromatics. For example, the raffinate can include about 40 wt % or less BTX, about 30 wt % or less BTX, about 20 wt % or less BTX, or about 10 wt % or less BTX. At least a portion of the aromatics via line 477 can be recycled to the cracker 402 via the paraffin-rich feed in line 111 or directly recycled to the cracker 402 (not shown). Although not shown, at least a portion of the raffinate in line 479 can be recycled to the cracker 402 via the paraffin-rich feed in line 111 or directly recycled to the cracker 402. For example, from a low of about 20 wt %, about 25 wt %, or about 30 wt % to a high of about 40 wt %, about 45 wt %, or about 50 wt % of the raffinate can be recycled to the cracker 402. In an alternative example, from about 70 wt % to about 90 wt % of the raffinate in line 477 can be recycled to the cracker 402 via the paraffin-rich feed in line 111.

Returning to the de-propanizer 325, the $C_3$ and lighter hydrocarbons exiting via line 427 can be compressed using the one or more compressors 330 to provide compressed $C_3$ and lighter hydrocarbons via line 432. Compressing the $C_3$ and lighter hydrocarbons can facilitate the separation of lighter hydrocarbons from the heavier hydrocarbons via line 427. The compressed $C_3$ and lighter hydrocarbons exiting the one or more compressors 330 via line 432 can have a pressure of about 500 kPa to about 4,000 kPa, about 500 kPa to about 3,000 kPa, or about 500 kPa to about 2,000 kPa. The compressed $C_3$ and lighter hydrocarbons can exit the one or more compressors 330 at a temperature of from about 5° C. to about 100° C.

The compressed $C_3$ and lighter hydrocarbons via line 432 can be chilled using the one or more chill trains 335 to provide chilled $C_3$ and lighter hydrocarbons via line 437. The chilled $C_3$ and lighter hydrocarbons can exit the one or more chill trains 335 at a temperature of about −40° C. to about 40° C. For example, the chilled $C_3$ and lighter hydrocarbons via line 437 can have a temperature from about −20° C. to about 5° C.

The chilled $C_3$ and lighter hydrocarbons via line 437 can be introduced to the one or more de-methanizers 340 and selectively separated therein to provide an overhead having methane and/or $H_2$ via line 442 and a bottoms having $C_2$ and $C_3$ hydrocarbons via line 444. The de-methanizer overhead in line 442 can include from about 50 wt % to about 95 wt % methane. For example, the overhead in line 442 can include from about 70 wt % to about 90 wt % methane. The pressure of the overhead in line 442 can range from about 300 kPa to about 1,000 kPa. The de-methanizer bottoms in line 444 can include from about 20 wt % to about 50 wt % $C_2$ and from about 40 wt % to about 80 wt % $C_3$.

All or any portion of the methane exiting the de-methanizer 340 can be compressed using the one or more compressors 345 to provide a compressed methane via line 447, which can be recycled to the FCC system 200. About 15 vol % to about 35 vol %, about 20 vol % to about 35 vol %, about 25 vol % to about 35 vol %, or about 30 vol % to 35 vol % of the methane via line 442 can be recycled to the FCC system 200. The compressed methane via line 447 can be at a pressure of about 100 kPa to about 1,000 kPa and a temperature of about 25° C. to about 200° C. At least a portion of the methane in line 442 can be removed as a final product.

The $C_2$ and $C_3$ hydrocarbons via line 444 can be introduced to the one or more de-ethanizers 350 and selectively separated therein to provide an overhead having a $C_2$ hydrocarbon mixture via line 452 and a bottoms having a $C_3$ hydrocarbon mixture via line 454. The overhead via line 452 can include about 90 wt %, about 95 wt %, or about 99 wt % $C_2$. For example, the overhead in line 452 can include from about 5 wt % to about 70 wt % ethane and from about 30 wt % to about 95 wt % ethylene. The bottoms in line 454 can also include about 90 wt %, about 95 wt %, or about 99 wt % $C_3$. For example, the bottoms in line 454 can include from about 5 wt % to about 30 wt % propane and from about 70 wt % to about 95 wt % propylene.

The $C_2$ hydrocarbon mixture via line 452 can be introduced to the one more C2 splitters 355 and selectively separated therein to provide an overhead ("ethylene product") via line 457 and a bottoms ("ethane product") via line 459. For example, the ethylene product in line 457 can include from a low of about 90 wt %, about 91 wt %, or about 92 wt % to a high of about 97 wt %, about 98 wt %, or about 99 wt % ethylene. In an alternative example, the ethylene product in line 457 can include from a low of about 97.5 wt %, about 97.6 wt %, or about 97.7 wt % to a high of about 99.7 wt %, about 99.8 wt %, or about 99.9 wt % ethylene.

The ethane product in line 459 can include from a low of about 90 wt %, about 91 wt %, or about 92 wt % to a high of about 97 wt %, about 98 wt %, or about 99 wt % ethane. For example, the ethane product in line 459 can include from a low of about 97.5 wt %, about 97.6 wt %, or about 97.7 wt % to a high of about 99.7 wt %, about 99.8 wt %, or about 99.9 wt % ethane.

The $C_3$ hydrocarbon mixture via line 454 can be introduced to one or more C3 splitters 360 and selectively separated therein to provide an overhead ("propylene product" or "second product") via line 462 and a bottoms ("propane product") via line 464. The propane product in line 464 can include about 90 wt % or more, about 95 wt % or more, or about 99 wt % or more propane. The propylene product in line 462 can include about 80 wt % or more, about 90 wt % or more, or about 95 wt % or more propylene.

All or any portion of the propylene product via line 462 can be recycled via line 463 to the olefin-rich feed via line 104 and/or the FCC system 200 (not shown). For example, about 10 vol % to about 60 vol %, about 20 vol % to about 60 vol %, about 30 vol % to about 60 vol %, about 40 vol % to about 60 vol %, or about 50 vol % to about 60 vol % of the propylene product in line 462 can be recycled via line 463 to the olefin-rich feed via line 104 and/or to the FCC system 200 directly (not shown). In an alternative example, from about 60 vol % to about 100 vol %, about 70 vol % to about 100 vol %, about 80 vol % to about 100 vol %, or about 90 vol % to about 100 vol % of the propylene product in line 462 can be recycled via line 463 to the olefin-rich feed via line 104 and/or to the FCC system 200 directly (not shown). Recycling at least a portion of the propylene to the FCC system 200 via the olefin-rich feed in line 104 or directly can suppress propylene production in the FCC system 200, thereby increasing the ethylene yield.

All or any portion of the ethane product via line 459 can be recycled to the cracker 402 via the paraffin-rich feed in line 111. In addition, all or any portion of the propane product via line 464 can be recycled to the cracker 402 via the paraffin-rich feed in line 111. For example, from about 60 vol % to about 100 vol %, about 70 vol % to about 100 vol %, about 80 vol % to about 100 vol %, or about 90 vol % to about 100 vol % of the ethane product via line 459 and about 70 vol % to about 100 vol %, about 80 vol % to about 100 vol %, or about 90 vol % to about 100 vol % of the propane product via line 464 can be recycled to the cracker 402. In an alternative example, from about 15 vol % to about 55 vol %, about 25 vol % to about 55 vol %, about 35 vol % to about 55 vol %, or about 45 vol % to about 55 vol % of the propane product via line 464 can be recycled to the cracker 402. Additionally, about 15 vol % to about 45 vol %, about 25 vol % to about 45 vol %, or about 35 vol % to about 45 vol % of the ethane product via line 459 can be recycled to the cracker 402. At least a portion of the ethane product in line 459 can be removed as a finished product.

In one or more embodiments, an existing FCC system can be modified or retrofitted with the olefin/paraffin separation unit or system 100 to provide the design configuration and benefits discussed and described above. For example, the olefin/paraffin separation system 100 can be added as a debottlenecking tool. The existing FCC system can have a hydrocarbon introduced thereto, where the hydrocarbon can be a mixture of olefins and paraffins. At least a portion of the hydrocarbon introduced to the fluid catalytic cracking system can be diverted to a separation unit to separate the diverted hydrocarbon to produce an olefin-rich product comprising about 70 wt % or more olefins. The olefin-rich product can be introduced to the fluid catalytic cracker to crack at least a portion of the olefin-rich product in the presence of one or more catalysts at conditions sufficient to produce a cracked product comprising about 20 wt % or more $C_2$-$C_3$ olefins.

Embodiments of the present disclosure further relate to any one or more of the following paragraphs:

1. A method for producing a hydrocarbon comprising: separating a hydrocarbon comprising olefins and paraffins to produce an olefin-rich hydrocarbon comprising about 70 wt % or more olefins and a paraffin-rich hydrocarbon comprising about 70 wt % or more paraffins; and cracking at least a portion of the olefin-rich hydrocarbon in the presence of one or more catalysts at conditions sufficient to produce a cracked product comprising about 20 wt % or more $C_2$-$C_3$ olefins.

2. The method of paragraph 1, further comprising cracking the paraffin-rich hydrocarbon at conditions sufficient to produce a second cracked product comprising from about 10 wt % to about 60 wt % ethylene and from about 5 wt % to about 50 wt % propylene.

3. The method according to paragraph 1 or 2, wherein separating the hydrocarbon comprises: adsorbing at least a portion of any olefins contained in the hydrocarbon to provide an olefin-lean hydrocarbon; displacing at least a portion of the adsorbed olefins with a displacing medium to provide an olefin-rich hydrocarbon mixed with the displacing medium; fractionating the olefin-lean hydrocarbon to produce the paraffin-rich hydrocarbon; and fractionating the olefin-rich hydrocarbon mixed with the displacing medium to produce the olefin-rich hydrocarbon and a recycle displacing medium.

4. The method according to any one of paragraphs 1 to 3, wherein separating the hydrocarbon comprises recovering about 95% or more of the olefins contained in the hydro carbon.

5. The method according to any one of paragraphs 1 to 4, wherein separating the hydrocarbon comprises multi-bed adsorption.

6. The method according to any one of paragraphs 1 to 5, wherein the olefin-rich hydrocarbon comprises about 98.5 wt % or more $C_2$-$C_4$ olefins.

7. The method according to any one of paragraphs 1 to 6, wherein the hydrocarbon comprises about 60 wt % or more $C_2$-$C_{12}$ olefins and paraffins.

8. The method according to any one of paragraphs 1 to 7, wherein the hydrocarbon comprises about 75 wt % or more $C_2$-$C_5$ olefins and paraffins.

9. The method according to any one of paragraphs 1 to 8, wherein the olefin-rich hydrocarbon comprises about 95 wt % or more $C_2$-$C_5$ olefins and the paraffin-rich hydrocarbon comprises about 60 wt % or more $C_2$-$C_5$ paraffins.

10. A method for producing a hydrocarbon comprising: separating a hydrocarbon comprising: purifying the hydrocarbon to provide a purified hydrocarbon; adsorbing at least a portion of any olefins contained in the purified hydrocarbon to provide an olefin-lean hydrocarbon; displacing at least a portion of the adsorbed olefins with a displacing medium to provide an olefin-rich hydrocarbon mixed with the displacing medium; fractionating the olefin-lean hydrocarbon to produce a paraffin-rich product comprising about 60 wt % or more $C_2$-$C_5$ paraffins; and fractionating the olefin-rich hydrocarbon mixed with the displacing medium to produce an olefin-rich product comprising about 90 wt % or more $C_2$-$C_5$ olefins and a recycle displacing medium; and cracking at least a portion of the olefin-rich product in the presence of one or more catalysts at conditions sufficient to produce a cracked product comprising about 25 wt % or more $C_2$-$C_3$ olefins.

11. The method of paragraph 10, wherein the olefin-rich product is cracked at a temperature of from about 590° C. to about 675° C.

12. The method of paragraph 10 or 11, wherein adsorption of the olefins occurs within a multi-bed adsorption unit.

13. The method according to any one of paragraphs 10 to 12, wherein the olefin-rich product comprises about 98.5 wt % or more $C_2$-$C_4$ olefins.

14. The method according to any one of paragraphs 10 to 13, wherein the olefin-rich product is cracked at a pressure of about 68 kPa to about 690 kPa.

15. The method according to any one of paragraphs 10 to 14, further comprising fractionating the cracked product to provide a naphthenic mixture and an olefinic mixture.

16. The method according to any one of paragraphs 10 to 15, further comprising: compressing the olefinic mixture to produce a compressed olefinic mixture; treating the compressed olefinic mixture to produce a treated olefinic mixture; drying the treated olefinic mixture to produce a dried olefinic mixture; and separating the dried olefinic mixture to produce an overhead comprising $C_3$ and lighter hydrocarbons and a bottoms comprising $C_4$ and heavier hydrocarbons.

17. A system for producing a hydrocarbon comprising: a separation unit adapted to separate a hydrocarbon comprising olefins and paraffins to produce an olefin-rich hydrocarbon comprising about 70 wt % or more olefins and a paraffin-rich hydrocarbon comprising about 70 wt % or more $C_2$-$C_{12}$ paraffins; and a fluid catalytic cracking unit adapted to crack at least a portion of the olefin-rich hydrocarbon to produce a first cracked product comprising about 20 wt % or more $C_2$-$C_3$ olefins.

18. The system of paragraph 17, wherein the separation unit comprises a purifier, a multi-bed adsorber, and one or more fractionators.

19. The system of paragraph 18, wherein the multi-bed adsorber comprises two or more adsorption units.

20. The system according to any one of paragraph 17 to 19, further comprising a thermal cracking unit adapted to crack at least a portion of the paraffin-rich hydrocarbon to produce a second cracked product, wherein the thermal cracking unit is a steam pyrolytic cracker.

21. A method for retrofitting a fluid catalytic cracking system having a hydrocarbon comprising a mixture of olefins and paraffins introduced thereto, the method comprising diverting at least a portion of the hydrocarbon introduced to the fluid catalytic cracking system to a separation unit to separate the diverted hydrocarbon to produce an olefin-rich product comprising about 70 wt % or more olefins; and introducing the olefin-rich product to the fluid catalytic cracker to crack at least a portion of the olefin-rich product in the presence of one or more catalysts at conditions sufficient to produce a cracked product comprising about 20 wt % or more $C_2$-$C_3$ olefins.

22. The method of paragraph 21, wherein separating the diverted hydrocarbon comprises adsorbing at least a portion of any olefins contained in the diverted hydrocarbon to provide an olefin-lean hydrocarbon; displacing at least a portion of the adsorbed olefins with a displacing medium to provide an olefin-rich hydrocarbon mixed with the displacing medium; fractionating the olefin-lean hydrocarbon to produce a paraffin-rich product comprising about 60 wt % or more $C_2$-$C_5$ paraffins; and fractionating the olefin-rich hydrocarbon mixed with the displacing medium to produce the olefin-rich product and a recycle displacing medium.

23. The method of paragraph 21 or 22, wherein adsorption of the olefins occurs within a multi-bed adsorption unit.

24. The method according to any one or paragraphs 21 to 23, wherein the olefin-rich product comprises about 98.5 wt % or more $C_2$-$C_4$ olefins.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for producing a hydrocarbon comprising:

contacting a hydrocarbon comprising olefins and paraffins with an adsorbent;

adsorbing at least a portion of the olefins to provide an olefin-lean hydrocarbon;

displacing at least a portion of the adsorbed olefins from the adsorbent with a displacement medium to provide a mixture of the displacement medium and an olefin-rich hydrocarbon comprising about 95 wt % or more olefins;

fractionating the olefin-lean hydrocarbon to provide a first recycle displacement medium and a paraffin-rich hydrocarbon comprising about 70 wt % or more paraffins;

separating the displacement medium from the olefin-rich hydrocarbon to produce a second recycle displacement medium;

cracking at least a portion of the olefin-rich hydrocarbon in the presence of one or more catalysts at a temperature of about 605° C. to about 670° C. to produce a first cracked product comprising about 95 wt % or more $C_2$-$C_{10}$ hydrocarbons, wherein the $C_2$-$C_{10}$ hydrocarbons comprise about 20 wt % or more $C_2$-$C_3$ olefins;

separating the first cracked product to provide an ethylene product; and recycling at least a portion of the ethylene product to the olefin-rich hydrocarbon prior to cracking.

2. The method of claim 1, further comprising cracking the paraffin-rich hydrocarbon at conditions sufficient to produce a second cracked product comprising from about 10 wt % to about 60 wt % ethylene and from about 5 wt % to about 50 wt % propylene.

3. The method of claim 2, further comprising:

mixing the first cracked product with the second cracked product prior to separating the first cracked product to provide the ethylene product.

4. The method of claim 1, wherein adsorbing at least a portion of the olefins comprises recovering about 95 wt % or more of the olefins contained in the hydrocarbon.

5. The method of claim 1, wherein adsorbing at least a portion of the olefins comprises multi-bed adsorption.

6. The method of claim 1, wherein the olefin-rich hydrocarbon comprises about 99.99 wt % olefins.

7. The method of claim 1, wherein the paraffin-rich hydrocarbon comprises about 90 wt % or more $C_2$-$C_{12}$ paraffins.

8. The method of claim 1, wherein the hydrocarbon comprises about 75 wt % or more $C_2$-$C_5$ olefins and paraffins.

9. The method of claim 8, wherein the olefin-rich hydrocarbon comprises about 95 wt % or more $C_2$-$C_5$ olefins and the paraffin-rich hydrocarbon comprises about 60 wt % or more $C_2$-$C_5$ paraffins.

10. The method of claim 1, wherein cracking the olefin-rich hydrocarbon in the presence of one or more catalysts further comprises conditions comprising a residence time of less than 2 seconds, temperatures of about 615° C. to about 650° C., and pressures from about 650 kPa to about 725 kPa.

11. The method of claim 1, wherein the olefin-rich hydrocarbon comprises about 98.5 wt % or more $C_2$-$C_4$ olefins.

12. The method of claim 1, further comprising:

separating the first cracked product to provide a methane product and a bottoms product comprising $C_2$ and $C_3$ hydrocarbons;

recycling at least a portion of the methane product to the olefin-rich hydrocarbon prior to cracking;

cracking at least a portion of the paraffin-rich hydrocarbon to provide a second cracked product; and recycling a portion of the bottoms product to the paraffin-rich hydrocarbon prior to cracking.

13. A method for producing a hydrocarbon comprising:

separating a hydrocarbon comprising olefins and paraffins, comprising:

purifying the hydrocarbon to provide a purified hydrocarbon;

contacting the purified hydrocarbon with an adsorbent;

adsorbing at least a portion of any olefins contained in the purified hydrocarbon to provide an olefin-lean hydrocarbon;

displacing at least a portion of the adsorbed olefins with a displacement medium to provide an olefin-rich hydrocarbon mixed with the displacement medium;

fractionating the olefin-lean hydrocarbon to produce a paraffin-rich product comprising about 60 wt % or more $C_2$-$C_5$ paraffins;

fractionating the olefin-rich hydrocarbon mixed with the displacement medium to produce an olefin-rich product comprising about 95 wt % or more olefins and a recycle displacement medium;

cracking at least a portion of the olefin-rich product in the presence of one or more catalysts at conditions comprising temperatures from about 605° C. to about 670° C. to produce a cracked product comprising about 95 wt % or more $C_2$-$C_{10}$ hydrocarbons, wherein the $C_2$-$C_{10}$ hydrocarbons comprise about 20 wt % or more $C_2$-$C_3$ olefins;

separating the cracked product to provide an ethylene product; and recycling at least a portion of the ethylene product to the olefin-rich hydrocarbon prior to cracking.

14. The method of claim 13, wherein the olefin-rich product is cracked at a temperature of from about 615° C. to about 650° C.

15. The method of claim 13, wherein adsorption of the olefins occurs within a multi-bed adsorption unit.

16. The method of claim 13, wherein the olefin-rich product comprises about 99.99 wt % olefins.

17. The method of claim 13, wherein the olefin-rich product is cracked at a pressure of about 68 kPa to about 690 kPa.

18. The method of claim 13, wherein separating the cracked product to provide the ethylene product comprises fractionating the cracked product to produce a naphthenic mixture and an olefinic mixture, and separating the olefinic mixture to provide the ethylene product.

19. The method of claim 18, further comprising:

compressing the olefinic mixture to produce a compressed olefinic mixture;

treating the compressed olefinic mixture to produce a treated olefinic mixture;

drying the treated olefinic mixture to produce a dried olefinic mixture;

separating the dried olefinic mixture to produce an overhead comprising $C_3$ and lighter hydrocarbons and a bottoms comprising $C_4$ and heavier hydrocarbons; and separating the overhead comprising $C_3$ and lighter hydrocarbons to provide the ethylene product.

20. A method for retrofitting a fluid catalytic cracking system having a hydrocarbon comprising a mixture of olefins and paraffins introduced thereto, the method comprising:

diverting at least a portion of the hydrocarbon to be introduced to the fluid catalytic cracking system to a separation unit comprising an adsorbent prior to being introduced to the fluid catalytic cracking system;

contacting the at least a portion of the hydrocarbon with the adsorbent;

adsorbing at least a portion of the olefins to provide an olefin-lean hydrocarbon;

displacing at least a portion of the adsorbed olefins from the adsorbent with a displacement medium to provide a mixture of the displacement medium and an olefin-rich hydrocarbon comprising about 95 wt % or more olefins;

fractionating the olefin-lean hydrocarbon to provide a first recycle displacement medium and a paraffin-rich hydrocarbon comprising about 70 wt % or more paraffins;

fractionating the mixture of the olefin-rich hydrocarbon and the displacement medium to produce the olefin-rich hydrocarbon and a second recycle displacement medium;

introducing the olefin-rich hydrocarbon to a fluid catalytic cracker to crack at least a portion of the olefin-rich hydrocarbon in the presence of one or more catalysts at conditions comprising temperatures from about 605° C. to about 670° C. to produce a first cracked product comprising about 95 wt % or more $C_2$-$C_{10}$ hydrocarbons, wherein the $C_2$-$C_{10}$ hydrocarbons comprise about 20 wt % or more $C_2$-$C_3$ olefins;

separating the first cracked product to provide an ethylene product; and recycling at least a portion of the ethylene product to the olefin-rich hydrocarbon prior to cracking.

21. The method of claim 20, wherein adsorption of the olefins occurs within a multi-bed adsorption unit.

22. The method of claim 20, wherein the olefin-rich product comprises about 99.99 wt % olefins.

* * * * *